US007491316B2

(12) United States Patent
Ketley et al.

(10) Patent No.: US 7,491,316 B2
(45) Date of Patent: Feb. 17, 2009

(54) PREPARATION OF COMPONENTS FOR REFINERY BLENDING OF TRANSPORTATION FUELS

(75) Inventors: Graham W. Ketley, Farnham (GB); Ton Knox, Crowthorne (GB); Janet L. Yedinak, Westmont, IL (US)

(73) Assignee: BP Corporation North America Inc., Warrenville, IL (US)

( * ) Notice: Subject to any disclaimer, the term of this patent is extended or adjusted under 35 U.S.C. 154(b) by 349 days.

(21) Appl. No.: 10/902,443

(22) Filed: Jul. 29, 2004

(65) Prior Publication Data

US 2006/0021913 A1 Feb. 2, 2006

(51) Int. Cl.
*C10G 27/04* (2006.01)

(52) U.S. Cl. ..... 208/208 R; 208/254 R

(58) Field of Classification Search ..... 208/208 R, 208/254 R

See application file for complete search history.

(56) References Cited

U.S. PATENT DOCUMENTS

| | | | | |
|---|---|---|---|---|
| 3,919,402 | A * | 11/1975 | Guth et al. | 423/522 |
| 6,843,978 | B2 * | 1/2005 | Canos et al. | 423/713 |
| 6,942,847 | B2 * | 9/2005 | Harbuzaru et al. | 423/718 |

FOREIGN PATENT DOCUMENTS

| | | |
|---|---|---|
| AU | 0132809 | 5/2001 |
| DE | 0565324 | 4/1993 |
| ES | 02083819 | 10/2002 |
| GB | 1243333 | 11/2000 |
| WO | WO-01/32809 A1 * | 5/2001 |

OTHER PUBLICATIONS

Hulea V et al, "Mild Oxidation with H2O2 over Ti-Containing Molecular Sieves—A very Efficient Method for Removing Aromatic Sulfur Compounds from Fuels" Journal of Catalysis, Academic Press, Duluth, MN, US, vol. 198, No. 2, (2001).

* cited by examiner

*Primary Examiner*—Glenn Caldarola
*Assistant Examiner*—Randy Boyer
(74) *Attorney, Agent, or Firm*—Ekkehard Schoettle

(57) ABSTRACT

The process of the present invention involves reducing the sulfur and/or nitrogen content of a distillate feedstock to produce a refinery transportation fuel or blending components for refinery transportation fuel, by contacting the feedstock with an oxygen-containing gas in an oxidation zone at oxidation conditions in the presence of an oxidation catalyst comprising a zeolitic material, TIQ-6, whose chemical composition corresponds to the formula, expressed as oxides, $$SiO_2{:}zZO_2{:}mMO_2{:}xX_2O_3{:}aH_2O$$

Wherein
Z is Ge, Sn,
z is between 0 and 0.25 mol.mol$^{-1}$
M is Ti or Zr,
M has a value between 0.00001 and 0.25, preferably between 0.001 and 0.01, and
a=has a value between 0 and 2.

8 Claims, No Drawings

PREPARATION OF COMPONENTS FOR REFINERY BLENDING OF TRANSPORTATION FUELS

FIELD OF THE INVENTION

The present invention relates to fuels for transportation which are derived from natural petroleum, particularly processes for the production of components for refinery blending of transportation fuels which are liquid at ambient conditions. More specifically, it relates to a process which includes oxidation of a petroleum distillate in order to oxidize nitrogen and/or sulfur-containing organic impurities therein, by contacting the petroleum distillate with an oxygen-containing gas at oxidation conditions in the presence of a heterogeneous catalyst comprising the zeolitic material. This oxidation step results in the direct oxidation of a portion of the sulfur-containing organic impurities to sulfur dioxide and/or sulfur trioxide. A portion of any remaining oxidized sulfur-containing compounds is then removed from the distillate via any conventional selective separation process such as adsorption, washing, distillation and solvent extraction in order to recover components for refinery blending of transportation fuels which are friendly to the environment.

BACKGROUND OF THE INVENTION

It is well known that internal combustion engines have revolutionized transportation following their invention during the last decades of the 19th century. While others, including Benz and Gottleib Wilhelm Daimler, invented and developed engines using electric ignition of fuel such as gasoline, Rudolf C. K. Diesel invented and built the diesel engine which employs compression for auto-ignition of the fuel in order to utilize low-cost organic fuels. Development of improved diesel engines for use in transportation has proceeded hand-in-hand with improvements in diesel fuel compositions. Modern high performance diesel engines demand ever more advanced specification of fuel compositions, but cost remains an important consideration.

At the present time most fuels for transportation are derived from natural petroleum. Indeed, petroleum as yet is the world's main source of hydrocarbons used as fuel and petrochemical feedstock. While compositions of natural petroleum or crude oils are significantly varied, all crudes contain sulfur compounds and most contain nitrogen compounds which may also contain oxygen, but oxygen content of most crudes is low. Generally, sulfur concentration in crude is less than about 8 percent, with most crudes having sulfur concentrations in the range from about 0.5 to about 1.5 percent. Nitrogen concentration is usually less than 0.2 percent, but it may be as high as 1.6 percent.

Crude oil seldom is used in the form produced at the well, but is converted in oil refineries into a wide range of fuels and petrochemical feedstocks. Typically fuels for transportation are produced by processing and blending of distilled fractions from the crude to meet the particular end use specifications. Because most of the crudes available today in large quantity are high in sulfur, the distilled fractions must be desulfurized to yield products which meet performance specifications and/or environmental standards. Sulfur-containing organic compounds in fuels continues to be a major source of environmental pollution. During combustion they are converted to sulfur oxides, which in turn, give rise to sulfur oxyacids and, also, contribute to particulate emissions.

Even in newer, high performance diesel engines combustion of conventional fuel produces smoke in the exhaust.

Oxygenated compounds and compounds containing few or no carbon-to-carbon chemical bonds, such as methanol and dimethyl ether, are known to reduce smoke and engine exhaust emissions. However, most such compounds have high vapor pressure and/or are nearly insoluble in diesel fuel, and they have poor ignition quality, as indicated by their cetane numbers. Furthermore, other methods of improving diesel fuels by chemical hydrogenation to reduce their sulfur and aromatics contents, also causes a reduction in fuel lubricity. Diesel fuels of low lubricity may cause excessive wear of fuel injectors and other moving parts which come in contact with the fuel under high pressures.

Distilled fractions used for fuel or a blending component of fuel for use in compression ignition internal combustion engines (Diesel engines) are middle distillates that usually contain from about 1 to 3 percent by weight sulfur. In the past a typical specification for Diesel fuel was a maximum of 0.5 percent by weight. By 1993 legislation in Europe and United States limited sulfur in Diesel fuel to 0.3 weight percent. By 1996 in Europe and United States, and 1997 in Japan, maximum sulfur in Diesel fuel was reduced to no more than 0.05 weight percent. This worldwide trend must be expected to continue to even lower levels for sulfur.

The US Environmental Protection Agency is targeting a level of sulfur less than 15 ppm in 2006 for on-road diesel. The European Union specification will be less than 50 ppm in 2005. Further the World Wide Fuels Charter as supported by all global automobile manufacturers proposes even more stringent sulfur requirements of 5 to 10 ppm for the Category IV fuels for "advanced " countries. In order to comply with these regulations for ultra-low sulfur content fuels, refiners will have to make fuels having even lower sulfur levels at the refinery gate. Thus refiners are faced with the challenge of reducing the sulfur levels in fuels and in particular diesel fuel within the timeframes prescribed by the regulatory authorities.

In one aspect, pending introduction of new emission regulations in California and other jurisdictions has prompted significant interest in catalytic exhaust treatment. Challenges of applying catalytic emission control for the diesel engine, particularly the heavy-duty diesel engine, are significantly different from the spark ignition internal combustion engine (gasoline engine) due to two factors. First, the conventional three-way catalyst (TWC) catalyst is ineffective in removing NOx emissions from diesel engines, and second, the need for particulate control is significantly higher than with the gasoline engine.

Several exhaust treatment technologies are emerging for control of Diesel engine emissions, and in all sectors the level of sulfur in the fuel affects efficiency of the technology. Sulfur is a catalyst poison that reduces catalytic activity. Furthermore, in the context of catalytic control of Diesel emissions, high fuel sulfur also creates a secondary problem of particulate emission, due to catalytic oxidation of sulfur and reaction with water to form a sulfate mist. This mist is collected as a portion of particulate emissions.

Compression ignition engine emissions differ from those of spark ignition engines due to the different method employed to initiate combustion. Compression ignition requires combustion of fuel droplets in a very lean air/fuel mixture. The combustion process leaves tiny particles of carbon behind and leads to significantly higher particulate emissions than are present in gasoline engines. Due to the lean operation the CO and gaseous hydrocarbon emissions are significantly lower than the gasoline engine. However, significant quantities of unburned hydrocarbon are adsorbed on the carbon particulate. These hydrocarbons are referred to as SOF (soluble organic fraction).

While an increase in combustion temperature can reduce particulate, this leads to an increase in NOx emission by the well-known Zeldovitch mechanism. Thus, it becomes necessary to trade off particulate and NOx emissions to meet emissions legislation.

Available evidence strongly suggests that ultra-low sulfur fuel is a significant technology enabler for catalytic treatment of diesel exhaust to control emissions. Fuel sulfur levels of below 15 ppm, likely, are required to achieve particulate levels below 0.01 g/bhp-hr. Such levels would be very compatible with catalyst combinations for exhaust treatment now emerging, which have shown capability to achieve NOx emissions around 0.5 g/bhp-hr. Furthermore, NOx trap systems are extremely sensitive to fuel sulfur and available evidence suggests that they would need sulfur levels below 10 ppm to remain active.

In the face of ever-tightening sulfur specifications in transportation fuels, sulfur removal from petroleum feedstocks and products will become increasingly important in years to come.

Conventional hydrodesulfurization (HDS) catalysts can be used to remove a major portion of the sulfur from petroleum distillates for the blending of refinery transportation fuels, but they are not efficient for removing sulfur from compounds where the sulfur atom is sterically hindered as in multi-ring aromatic sulfur compounds. This is especially true where the sulfur heteroatom is doubly hindered (e.g., 4,6-dimethyldibenzothiophene). These hindered dibenzothiophenes predominate at low sulfur levels such as 50 to 100 ppm and would require severe process conditions to be desulfurized. Using conventional hydrodesulfurization catalysts at high temperatures would cause yield loss, faster catalyst coking, and product quality deterioration (e.g., color). Using high pressure requires a large capital outlay.

In order to meet stricter specifications in the future, such hindered sulfur compounds will also have to be removed from distillate feedstocks and products. There is a pressing need for economical removal of sulfur from distillates and other hydrocarbon products.

The art is replete with processes said to remove sulfur from distillate feedstocks and products. One known method involves the oxidation of petroleum fractions containing at least a major amount of material boiling above very high-boiling hydrocarbon materials (petroleum fractions containing at least a major amount of material boiling above about 550° F.) followed by treating the effluent containing the oxidized compounds at elevated temperatures to form hydrogen sulfide (500° F. to 1350° F.) and/or hydroprocessing to reduce the sulfur content of the hydrocarbon material. See, for example, U.S. Pat. No. 3,847,798 (Jin Sun Yoo, et al) and U.S. Pat. No. 5,288,390 (Vincent A. Durante). Such methods have proven to be of only limited utility since only a rather low degree of desulfurization is achieved. In addition, substantial loss of valuable products may result due to cracking and/or coke formation during the practice of these methods. Therefore, it would be advantageous to develop a process which gives an increased degree of desulfurization while decreasing cracking or coke formation.

Several different oxygenation methods for improving fuels have also been described in the past. For example, U.S. Pat. No. 2,521,698 (G. H. Denison, Jr. et al.) describes a partial oxidation of hydrocarbon fuels as improving cetane number. This patent suggests that the fuel should have a relatively low aromatic ring content and a high paraffinic content. U.S. Pat. No. 2,912,313 (James B. Hinkamp et al.) states that an increase in cetane number is obtained by adding both a peroxide and a dihalo compound to middle distillate fuels. U.S. Pat. No. 2,472,152 (Adalbert Farkas et al.) describes a method for improving the cetane number of middle distillate fractions by the oxidation of saturated cyclic hydrocarbon or naphthenic hydrocarbons in such fractions to form naphthenic peroxides. This patent suggests that the oxidation may be accelerated in the presence of an oil-soluble metal salt as an initiator, but is preferably carried out in the presence of an inorganic base. However, the naphthenic peroxides formed are deleterious gum initiators. Consequently, gum inhibitors such as phenols, cresols and cresyic acids must be added to the oxidized material to reduce or prevent gum formation. These latter compounds are toxic and carcinogenic.

U.S. Pat. No. 4,494,961 (Chaya Venkat et al.) relates to improving the cetane number of raw, untreated, highly aromatic, middle distillate fractions having a low hydrogen content by contacting the fraction at a temperature of from 50° C. to 350° C. and under mild oxidizing conditions in the presence of a catalyst which is either (i) an alkaline earth metal permanganate, (ii) an oxide of a metal of Groups IB, IIB, IIIB, IVB, VB, VIB, VIIB or VIIIB of the periodic table, or a mixture of (i) and (ii).

European Patent Application 0 252 606 A2 also relates to improving the cetane rating of a middle distillate fuel fraction which may be hydro-refined by contacting the fraction with oxygen or oxidant, in the presence of catalytic metals such as tin, antimony, lead, bismuth and transition metals of Groups IB, IIB, VB, VIB, VIIB and VIIIB of the periodic table, preferably as an oil-soluble metal salt. The application states that the catalyst selectively oxidizes benzylic carbon atoms in the fuel to ketones.

U.S. Pat. No. 4,723,963 (William F. Taylor) suggests that cetane number is improved by including at least 3 weight percent oxygenated aromatic compounds in middle distillate hydrocarbon fuel boiling in the range of 160° C. to 400° C. This patent states that the oxygenated alkylaromatics and/or oxygenated hydroaromatics are preferably oxygenated at the benzylic carbon proton.

U.S. Pat. No. 6,087,544 (Robert J. Wittenbrink et al.) relates to processing a distillate feedstream to produce distillate fuels having a level of sulfur below the distillate feedstream. Such fuels are produced by fractionating a distillate feedstream into a light fraction, which contains only from about 50 to 100 ppm of sulfur, and a heavy fraction. The light fraction is hydrotreated to remove substantially all of the sulfur therein. The desulfurized light fraction, is then blended with one half of the heavy fraction to produce a low sulfur distillate fuel, for example 85 percent by weight of desulfurized light fraction and 15 percent by weight of untreated heavy fraction reduced the level of sulfur from 663 ppm to 310 ppm. However, to obtain this low sulfur level only about 85 percent of the distillate feedstream is recovered as a low sulfur distillate fuel product.

U.S. patent application Publication 2002/0035306 A1 (Gore et al.) discloses a multi-step process for desulfurizing liquid petroleum fuels that also removes nitrogen-containing compounds and aromatics. The process steps are thiophene extraction; thiophene oxidation; thiophene-oxide and dioxide extraction; raffinate solvent recovery and polishing; extract solvent recovery; and recycle solvent purification.

The Gore et al. process seeks to remove 5-65% of the thiophenic material and nitrogen-containing compounds and parts of the aromatics in the feedstream prior to the oxidation step. While the presence of aromatics in diesel fuel tends to suppress cetane, the Gore et al. process requires an end use for the extracted aromatics. Further, the presence of an effective amount of aromatics serves to increase the fuel density (Btu/gal) and enhance the cold flow properties of diesel fuel. Therefore it is not prudent to extract an inordinate amount of the aromatics.

With respect to the oxidation step, the oxidant is prepared in situ or is previously formed. Operating conditions include a molar ratio of $H_2O_2$ to S between about 1:1 and 2.2:1; acetic acid content between about 5 and 45% of feed, solvent content between 10 and 25% of feed, and a catalyst volume of less than about 5,000 ppm sulfuric acid, preferably less than 1,000 ppm. Gore et al. also discloses the use of an acid catalyst in the oxidation step, preferably sulfuric acid. The use of sulfuric acid as an oxidizing acid is problematic in that corrosion is a concern when water is present and hydrocarbons can be sulfonated when a little water is present.

According to Gore et al. the purpose of the thiophene-oxide and dioxide extraction step is to remove more than 90% of the various substituted benzo- and dibenzo thiophene-oxides and N-oxide compounds plus a fraction of the aromatics with an extracting solvent that is aqueous acetic acid with one or more co-solvents.

U.S. Pat. No. 6,368,495 B1 (Kocal et al.) also discloses a multi-step process for the removal of thiophenes and thiophene derivatives from petroleum fractions. This subject process involves the steps of contacting a hydrocarbon feed stream with an oxidizing agent followed by the contact of the oxidizing step effluent with a solid decomposition catalyst to decompose the oxidized sulfur-containing compounds thereby yielding a heated liquid stream and a volatile sulfur compound. The subject patent discloses the use of oxidizing agents such as alkyl hydroperoxides, peroxides, percarboxylic acids, and oxygen.

WO 02/18518 A1 (Rappas et al) discloses a two-stage desulfurization process which is utilized downstream of a hydrotreater. The process involves an aqueous formic acid based, hydrogen peroxide biphasic oxidation of a distillate to convert thiophenic sulfur to corresponding sulfones. During the oxidation process, some sulfones are extracted into the oxidizing solution. These sulfones are removed from the hydrocarbon phase by a subsequent phase separation step. The hydrocarbon phase containing remaining sulfones is then subjected to a liquid-liquid extraction or solid adsorption step.

The use of formic acid in the oxidation step is not advisable. Formic acid is relatively more expensive than acetic acid. Further, formic acid is considered a "reducing" solvent and can hydride certain metals thereby weakening them. Therefore, exotic alloys are required to handle formic acid. These expensive alloys would have to be used in the solvent recovery section and storage vessels. The use of formic acid also necessitates the use of high temperatures for the separation of the hydrocarbon phase from the aqueous oxidant phase in order to prevent the appearance of a third precipitated solid phase. It is believed this undesirable phase can be formed due to the poor lipophilicity of formic acid. Therefore at lower temperatures, formic acid cannot maintain in solution some of the extracted sulfones.

U.S. Pat. No. 6,171,478 B1 (Cabrera et al.) discloses yet another complex multi-step desulfurization process. Specifically, the process involves a hydrodesulfurization step, an oxidizing step, a decomposition step, and a separation step wherein a portion of the sulfur-oxidated compounds are separated from the effluent stream of the decomposition step. The aqueous oxidizing solution used in the oxidizing step preferably contains acetic acid and hydrogen peroxide. Any residual hydrogen peroxide in the oxidizing step effluent is decomposed by contacting the effluent with a decomposition catalyst.

The separation step is carried out with a selective solvent to extract the sulfur-oxidated compounds. Per the teachings of Cabrera et al. the preferred selective solvents are acetonitrile, dimethyl formamide, and sulfolane.

A number of solvents have been proposed for removing the oxidized sulfur compounds. For example, in U.S. Pat. No. 6,160,193 (Gore) teaches the use of a wide variety of solvents suitable for use in the extraction of sulfones. The preferred solvent is Dimethylsulfoxide (DMSO).

A study of a similar list of solvents used in the extraction of sulfur compounds was published by Otsuki, S.; Nonaka, T.; Takashima, N.; Qian, W.; Ishihara, A.; Imai, T.; Kabe, T. "Oxidative Desulfurization of Light Gas Oil and Vacuum Gas Oil by Oxidation and Solvent Extraction" Energy & Fuels 2000, 14, 1232. That list is displayed below:

N,N-Dimethylformamide (DMF)
Methanol
Acetonitrile
Sulfolane

Gore states that there is a relationship between the solvent's polarity with the solvent's extraction efficiency. All of the solvents listed in the patent and the paper are desirably immiscible with the diesel. They are all characterized as either polar protic or aprotic solvents.

WO 01/32809 discloses another process for selectively oxidizing distillate fuel or middle distillates. The subject reference discloses that oxidized distillate fuels such that hydroxyl and or carbonyl groups are chemically bound to paraffinic molecules in the fuel results in a reduction in particulates generated upon combustion of the fuel versus unoxidized fuel. The reference discloses a process for selectively oxidizing saturated aliphatic or cyclic compounds in the fuel in the presence of various titanium containing silicon based zeolites with peroxides, ozone or hydrogen peroxide such that hydroxyl or carbonyl groups are formed.

U.S. Pat. No. 6,402,939 B1 (Yen et al.) discloses a process for the oxidative desulfurization of fossil fuels using ultrasound. Briefly liquid fossil fuel is combined with an acidic aqueous solution comprising water and an hydroperoxide to form a multiphase reaction mixture followed by applying ultrasound to the multiphase reaction medium for a time sufficient to cause oxidation of sulfides to sulfones with are subsequently extracted.

U.S. patent application Publication 2001/0015339 A1 (Sherman) discloses a method of removing sulfur compounds from diesel fuel that involves forming oxidizing gas into sub micron size bubbles and dispersing these bubbles into flowing diesel fuel to oxidize the sulfur compounds into sulfoxides and/or sulfones.

In view of the above, it is clear that there is a need for a less complex, economic distillate or diesel desulfurization process that does not employ expensive hydrotreating technologies involving greater hydrogen useage or oxidation technologies that employ the use of expensive chemical oxidizing agents and avoids the attendant complex handling and corrosion issues.

The present invention provides for a relatively simple selective desulfurization process wherein a distillate feedstock is contacted with an oxygen-containing gas at oxidation conditions in the presence of a heterogeneous catalyst comprising a zeolitic material, TIQ-6 whose chemical composition corresponds to the formula, expressed as oxides, $$SiO_2{:}zZO_2{:}mMO_2{:}xX_2O_3{:}aH_2O$$

Wherein

Z is Ge, Sn, z is between 0 and 0.25 mol.mol$^{-1}$

M is Ti or Zr,

M has a value between 0.00001 and 0.25, preferably between 0.001 and 0.01, and a=has a value between 0 and 2.

In another embodiment, the catalyst comprises METIQ-6 which is a TIQ-6 material that has organic groups anchored on its surface. This METIQ-6 material has a chemical composition which can be represented by the formula:

$$SiO_2{:}yYR_pO_{2-p/2}{:}zZO_2{:}mMO_2{:}xX_2O_3{:}aH_2O$$

wherein

R is selected among hydrogen, alkyl groups with 1 to 22 carbon atoms, aryl groups with 6 to 36 carbon atoms, aromatic groups with 6 to 36 carbon atoms, polyaromatic groups with 6 to 36 carbon atoms and these groups are selected among non functionalized groups and fictionalized groups with functional groups selected among acid, amino, thiol, sulphonic and tetra-alkyl ammonium groups, Y is Si, Ge, Sn or Ti and is directly joined to atoms making up a structure by means of C—Y bonds, p has a value between 1 and 3, y has a value between 0.001 and 1, Z is GE or Sn, z has a value between 0 and 0.25 mol.mol$^{-1}$, M is Ti or Zr, m has a value between 0.00001 and 0.25, preferably between 0.001 and 0.1, X is Al, Ga or B, x has a value between 0 and 1, and a has a value between 0 and 2.

SUMMARY OF THE INVENTION

The process of the present invention involves reducing the sulfur and/or nitrogen content of a distillate feedstock to produce a refinery transportation fuel or blending components for refinery transportation fuel, by contacting the feedstock with an oxygen-containing gas in an oxidation zone at oxidation conditions in the presence of an oxidation catalyst comprising a zeolitic material, TIQ-6, whose chemical composition corresponds to the formula, expressed as oxides, $$SiO_2{:}zZO_2{:}mMO_2{:}xX_2O_3{:}aH_2O$$

Wherein

Z is Ge, Sn, z is between 0 and 0.25 mol.mol$^{-1}$

M is Ti or Zr,

M has a value between 0.00001 and 0.25, preferably between 0.001 and 0.01, X is Al, Ga or B, and a=has a value between 0 and 2.

In another embodiment the present invention involves carrying out the oxidation process in the presence of an oxidation catalyst that comprises an METIQ-6 material that has a chemical composition which can be represented by the formula:

$$SiO_2{:}yYR_pO_{2-p/2}{:}zZO_2{:}mMO_2{:}xX_2O_3{:}aH_2O$$

wherein

R is selected among hydrogen, alkyl groups with 1 to 22 carbon atoms, aryl groups with 6 to 36 carbon atoms, aromatic groups with 6 to 36 carbon atoms, polyaromatic groups with 6 to 36 carbon atoms and these groups are selected among non functionalized groups and functionalized groups with functional groups selected among acid, amino, thiol, sulphonic and tetra-alkyl ammonium groups, Y is Si, Ge, Sn or Ti and is directly joined to atoms making up a structure by means of C—Y bonds, p has a value between 1 and 3, y has a value between 0.001 and 1, z is GE or Sn,

DETAILED DESCRIPTION OF THE INVENTION

Suitable feedstocks generally include refinery distillate streams boiling at a temperature range from about 50° C. to about 650° C., preferably 150° C. to about 400° C., and more preferably between about 175° C. and about 375° C. at atmospheric pressure for best results. These streams include, but are not limited to, virgin light middle distillate, virgin heavy middle distillate, fluid catalytic cracking process light catalytic cycle oil, coker still distillate, hydrocracker distillate, jet fuel, vacuum distillates and the collective and individually hydrotreated embodiments of these streams. The preferred streams are the collective and individually hydrotreated embodiments of fluid catalytic cracking process light catalytic cycle oil, coker still distillate, and hydrocracker distillate.

It is also anticipated that one or more of the above distillate streams can be combined for use as feedstock to the process of the invention. In many cases performance of the refinery transportation fuel or blending components for refinery transportation fuel obtained from the various alternative feedstocks may be comparable. In these cases, logistics such as the volume availability of a stream, location of the nearest connection and short-term economics may be determinative as to what stream is utilized.

In one aspect, this invention provides for the production of refinery transportation fuel or blending components for refinery transportation fuel from a hydrotreated petroleum distillate. Such a hydrotreated distillate is prepared by hydrotreating a petroleum distillate material boiling between about 50° C. and about 650° C. by a process which includes reacting the petroleum distillate with a source of hydrogen at hydrogenation conditions in the presence of a hydrogenation catalyst to assist by hydrogenation removal of sulfur and/or nitrogen from the hydrotreated petroleum distillate; optionally fractionating the hydrotreated petroleum distillate by distillation to provide at least one low-boiling blending component consisting of a sulfur-lean, mono-aromatic-rich fraction, and a high-boiling feedstock consisting of a sulfur-rich, mono-aromatic-lean fraction. In accordance with one embodiment of the process of the present invention the hydrotreated distillate or the low-boiling component can be used as suitable feedstocks for the process of the present invention.

Generally, useful hydrogenation catalysts comprise at least one active metal, selected from the group consisting of the d-transition elements in the Periodic Table, each incorporated onto an inert support in an amount of from about 0.1 percent to about 30 percent by weight of the total catalyst. Suitable active metals include the d-transition elements in the Periodic Table elements having atomic number in from 21 to 30, 39 to 48, and 72 to 78.

The catalytic hydrogenation process may be carried out under relatively mild conditions in a fixed, moving fluidized or ebullient bed of catalyst. Preferably a fixed bed or plurality of fixed beds of catalyst is used under conditions such that relatively long periods elapse before regeneration becomes necessary, for example an average reaction zone temperature of from about 200° C. to about 450° C., preferably from about 250° C. to about 400° C., and most preferably from about 275° C. to about 350° C. for best results, and at a pressure within the range of from about 6 to about 160 atmospheres.

A particularly preferred pressure range within which the hydrogenation provides extremely good sulfur removal while minimizing the amount of pressure and hydrogen required for the hydrodesulfurization step are pressures within the range of 20 to 60 atmospheres, more preferably from about 25 to 40 atmospheres.

Hydrogen circulation rates generally range from about 500 SCF/Bbl to about 20,000 SCF/Bbl, preferably from about 2,000 SCF/Bbl to about 15,000 SCF/Bbl, and most preferably from about 3,000 to about 13,000 SCF/Bbl for best results. Reaction pressures and hydrogen circulation rates below these ranges can result in higher catalyst deactivation rates resulting in less effective desulfurization, denitrogenation, and dearomatization. Excessively high reaction pressures increase energy and equipment costs and provide diminishing marginal benefits.

The hydrogenation process typically operates at a liquid hourly space velocity of from about 0.2 hr-I to about 10.0 $hr^{-1}$, preferably from about 0.5 $hr^{-1}$ to about 3.0 $hr^{-1}$, and most preferably from about 1.0 $hr^{-1}$ to about 2.0 $hr^{-1}$ for best results. Excessively high space velocities will result in reduced overall hydrogenation.

Further reduction of such heteroaromatic sulfides from a distillate petroleum fraction by hydrotreating would require that the stream be subjected to very severe catalytic hydrogenation in order to convert these compounds into hydrocarbons and hydrogen sulfide ($H_2S$). Typically, the larger any hydrocarbon moiety is, the more difficult it is to hydrogenate the sulfide. Therefore, the residual organo-sulfur compounds remaining after a hydrotreatment are the most tightly substituted sulfides.

Where the feedstock is a high-boiling distillate fraction derived from hydrogenation of a refinery stream, the refinery stream can be a material boiling between about 200° C. and about 425° C. Preferably the refinery stream can be a material boiling between about 250° C. and about 400° C., and more preferably boiling between about 275° C. and about 375° C.

Useful distillate fractions for hydrogenation can be any one, several, or all refinery streams boiling in a range from about 50° C. to about 650° C., preferably 150° C. to about 400° C., and more preferably between about 175° C. and about 375° C. at atmospheric pressure. The lighter hydrocarbon components in the distillate product are generally more profitably recovered to gasoline and the presence of these lower boiling materials in distillate fuels is often constrained by distillate fuel flash point specifications. Heavier hydrocarbon components boiling above 400° C. are generally more profitably processed as fluid catalytic cracker feed and converted to gasoline but are amenable for use in the process of the present invention. The presence of heavy hydrocarbon components in distillate fuels is further constrained by distillate fuel end point specifications.

The distillate fractions for hydrogenation can comprise high and low sulfur virgin distillates derived from high- and low-sulfur crudes, coker distillates, catalytic cracker light and heavy catalytic cycle oils, and distillate boiling range products from hydrocracker and resid hydrotreater facilities. Generally, coker distillate and the light and heavy catalytic cycle oils are the most highly aromatic feedstock components, ranging as high as 80 percent by weight. The majority of coker distillate and cycle oil aromatics are present as mono-aromatics and di-aromatics with a smaller portion present as tri-aromatics. Virgin stocks such as high and low sulfur virgin distillates are lower in aromatics content ranging as high as 20 percent by weight aromatics. Generally, the aromatics content of a combined hydrogenation facility feedstock will range from about 5 percent by weight to about 80 percent by weight, more typically from about 10 percent by weight to about 70 percent by weight, and most typically from about 20 percent by weight to about 60 percent by weight.

Sulfur concentration in distillate fractions useful in the present invention is generally a function of the high and low sulfur crude mix, the hydrogenation capacity of a refinery per barrel of crude capacity, and the alternative dispositions of distillate hydrogenation feedstock components. The higher sulfur distillate feedstock components are generally virgin distillates derived from high sulfur crude, coker distillates, and catalytic cycle oils from fluid catalytic cracking units processing relatively higher sulfur feedstocks. These distillate feedstock components can range as high as 2 percent by weight elemental sulfur but generally range from about 0.1 percent by weight to about 0.9 percent by weight elemental sulfur.

Nitrogen content of distillate fractions useful in the present invention is also generally a function of the nitrogen content of the crude oil, the hydrogenation capacity of a refinery per barrel of crude capacity, and the alternative dispositions of distillate hydrogenation feedstock components. The higher nitrogen distillate feedstocks are generally coker distillate and the catalytic cycle oils. These distillate feedstock components can have total nitrogen concentrations ranging as high as 2000 ppm, but generally range from about 5 ppm to about 900 ppm.

Typically, sulfur compounds in petroleum fractions are relatively non-polar, heteroaromatic sulfides such as substituted benzothiophenes and dibenzothiophenes. At first blush it might appear that heteroaromatic sulfur compounds could be selectively extracted based on some characteristic attributed only to these heteroaromatics. Even though the sulfur atom in these compounds has two, non-bonding pairs of electrons which would classify them as a Lewis base, this characteristic is still not sufficient for them to be extracted by a Lewis acid. In other words, selective extraction of heteroaromatic sulfur compounds to achieve lower levels of sulfur requires greater difference in polarity between the sulfides and the hydrocarbons.

By means of the heterogeneous catalyzed oxidation according to this invention, it is possible to selectively convert these sulfides directly to sulfur dioxide and/or sulfur trioxide and to the extent sulfides are not converted into sulfur dioxide and/or sulfur trioxide into, more polar, Lewis basic, oxygenated sulfur compounds such as sulfoxides and sulfones. A compound such as dimethylsulfide is a very non-polar molecule, whereas when oxidized, the molecule is very polar. Accordingly, by selectively oxidizing heteroaromatic sulfides such as benzo- and dibenzothiophene found in a refinery streams, processes of the invention are able to selectively bring about a higher polarity characteristic to these heteroaromatic compounds. Where the polarity of these unwanted sulfur compounds is increased by means of heterogeneously catalyzed oxidation according to this invention, they can be selectively separated by conventional solvent extraction, adsorption, washing, or distillation processes while the bulk of the hydrocarbon stream is unaffected. It is believed, another portion of the sulfur in the sulfur-containing compounds in the distillate feedstock is directly converted to sulfur dioxide and/or sulfur trioxide.

The process of the present invention also results in the oxidation of any nitrogen-containing species which can be simultaneously separated with the sulfur-containing species by the conventional solvent extraction, adsorption, washing, or distillation processes mentioned above.

Other compounds which also have non-bonding pairs of electrons include amines. Heteroaromatic amines are also found in the same stream that the above sulfides are found. Amines are more basic than sulfides. The lone pair of electrons functions as a Bronsted-Lowry base (proton acceptor) as well as a Lewis base (electron-donor). This pair of electrons on the atom makes it vulnerable to oxidation in manners similar to sulfides.

In one aspect, this invention provides a process for the production of refinery transportation fuel or blending components for refinery transportation fuel, which includes: providing a distillate feedstock comprising a mixture of hydrocarbons, sulfur-containing; contacting the feedstock with an oxygen-containing gas such as oxygen depleted air in an oxidation zone in the presence of and oxidation catalyst comprising the zeolitic material TIQ-6 and/or METIQ-6. Because oxygen depleted air can be used in the present invention, the concentration of oxygen can be less than about 21 vol. %. The oxygen-containing stream preferably should have an oxygen content of at least 0.01 vol. %. The gases can be supplied from air and inert diluents such as nitrogen if required. As those skilled in the art readily recognize, certain compositions are explosive and the composition of oxygen containing stream should be selected to avoid explosive regions. The oxygen-containing gas can be circulated in amounts ranging from 200 to 20,000 standard cubic feet per barrel.

The pressure in the oxidation zone can range from ambient to 3000 psig preferably from about 100 psig to about 400 psig, more preferably from about 150 psig to about 300 psig and most preferably from about 200 psig to about 300 psig.

The temperature in the oxidation zone can range from about 150° F. to about 500° F., preferably from about 200° F. to about 450° F. and most preferably from about 250° F. to about 350° F.

The oxidation process of the present invention operates at a liquid hourly space velocity of from about 0.1 $hr^{-1}$ to about 100 $hr^{-1}$, preferably from about 0.2 $hr^{-1}$ to about 50 $hr^{-}1$, and most preferably from about 0.5 $hr^{-1}$ to about 10 $hr^{-1}$ for best results. Excessively high space velocities will result in reduced overall oxidation.

Generally, the oxidation process of the present invention begins with a distillate feedstock preheating step. The distillate feedstock is preheated in feed/effluent heat exchangers prior to entering a furnace for final preheating to a targeted reaction zone temperature. The distillate feedstock can be contacted with an oxygen-containing stream prior to, during, and/or after preheating.

Since the oxidation reaction is generally exothermic, interstage cooling, consisting of heat transfer devices between fixed bed reactors or between catalyst beds in the same reactor shell, can be employed. At least a portion of the heat generated from the oxidation process can often be profitably recovered for use in the oxidation process. Where this heat recovery option is not available, cooling may be performed through cooling utilities such as cooling water or air, or through use of a quench stream injected directly into the reactors. Two-stage processes can provide reduced temperature exotherm per reactor shell and provide better oxidation reactor temperature control.

The reaction zone effluent is generally cooled and the effluent stream is directed to a separator device to remove the oxygen-containing gas which can be recycled back to the process. The oxygen-containing gas purge rate is often controlled to maintain a minimum or maximum oxygen content in the gas passed to the reaction zone. Recycled oxygen-containing gas is generally compressed, supplemented if required, with "make-up" oxygen or oxygen-containing gas (preferably air), and injected into the process for further oxidation.

The process of the present invention can be carried out in any sort of gas-liquid-solid reaction zone known to those skilled in the art. For instance, the reaction zone can consist of one or more fixed bed reactors. A fixed bed reactor can also comprise a plurality of catalyst beds. Additionally the reaction zone can be a fluid bed reactor, slurry, or trickle bed reactor. The simplification implied by the use of a heterogeneous catalyst would facilitate a range of less conventional applications for the process of the present invention. For instance, it is contemplated that the process of the invention can be carried out on skid mounted units at terminals or pipelines garage fore courts and on board fuel cell containing vehicles where sulfur sensitive hydrocarbon reformers and fuel cells are employed.

The oxidation catalysts used in the present invention comprise in one embodiment a zeolitic material, TIQ-6, whose chemical composition corresponds to the following formula, expressed as oxides, $$SiO_2{:}zZO_2{:}mMO_2{:}xX_2O_3{:}aH_2O$$

Wherein

Z is Ge, Sn, z is between 0 and 0.25 $mol.mol^{-1}$

M is Ti or Zr,

M has a value between 0.00001 and 0.25, preferably between 0.001 and 0.01, and a=has a value between 0 and 2.

TIQ-6 materials are disclosed in U.S. patent application Publication No. 2002/0193239 A1 (Corma Canos et al.) the teachings of which are incorporated herein by reference.

In accordance with the teachings of Corma Canos et al. the TIQ-6 material can be obtained from laminar precursors of zeolites synthesized with titanium and/or zirconium which is incorporated directly into its structure. More specifically, a delaminated TIQ-6 material is obtained, similar to the material ITQ-6, both proceeding from the laminar precursor of Ferrierite (FER), the preparation of which is indicated in the Spanish Patent P9801689 (1998) and in the patent application PCT/GB99/02567 (1999). The catalytic material obtained has Si—O-M bonds (M=Ti or Zr), the active species of titanium or zirconium being distributed in a homogeneous manner in order that they be functional in selective oxidation processes of organic compounds with organic or inorganic peroxides, and in general in processes which involve the use of Lewis acid centres.

The TIQ-6 material can be prepared by means of a procedure which comprises:

A first step wherein a laminar precursor is synthesized of the ferrieritic type with a structure which comprises at least one of Ti and Zr;

A second step wherein the laminar precursor is submitted to a swelling with a long-chain organic compound, in order to obtain a swollen laminar material;

A third step wherein the swollen laminar material is, at least partially, delaminated using techniques of mechanical stirring, ultrasounds, spray drying, liophilisation and combinations thereof;

A fourth step wherein the at least partially delaminated material is subjected to an acid treatment; and a fifth step wherein the at least partially delaminated material is subjected to calcination until at least part of the organic matter present in the material is eliminated in order to obtain a calcinated material.

In this process, the laminar precursor can be prepared by means of a mixing step which comprises mixing, in an autoclave, a silica source, a titanium and/or zirconium source, a fluoride salt and acid, a structure director organic compound, and water until a mixture is obtained; a heating step wherein the mixture is heated at autogenous pressure to between 100 and 200° C., preferably less than 200° C., with stirring, for 1 to 30 days, preferably between 2 and 15 days, until a synthesis material is obtained; and a final step wherein the synthesis material is filtered, washed and dried at a temperature less than 300° C. until the laminar precursor is obtained.

In the procedure described above, preferably use is made of a source of silica as pure as possible. Adequate silica sources are commercially available, for example under the trade names of AEROSIL (DEGUSSA AG), CAB-O-SIL (SCINTRAN BDH), LUDOX (DU PONT PRODUCTS); use can also be made of tetraethylorthosilicate (TEOS) and also combinations of various different sources of silica: The titanium source can be selected among TiCl (4), tetraethylorthotitanate (TEOTi) and combinations thereof, and the zirconium is selected from between ZrCl (4), zirconyl chloride and combinations thereof. As fluoride salt and acid, it is possible to use ammonium fluoride, hydrogen fluoride or combinations thereof.

The structure director organic compound is selected preferably between 1,4-diaminobutane, ethylendiamine, 1,4-dimethylpiperazine, 1,4-diaminocyclohexane, hexamethylen imine, pirrolidine, piridine and preferably 4-amino-2,2,6,6-tetramethylpiperidine and combinations thereof.

The METIQ-6 material can be obtained by means of a reaction with reagents selected among organogermanes, organosilanes, and organometals selected among organotitanium or organotin in order to produce organic species anchored on the surface of the materials described, at a reaction temperature between 0 and 400° C., preferably in gas phase between 50 and 200° C., of the TIQ-6 material, for so to produce organic species anchored on the surface of the materials described. Thus, for the reaction to produce organic species anchored on the surface an agent can be employed selected among $R_1$ $R_2$ $R_3$ (R')Y, $R_1$ $R_2$ $(R')_2$ Y, $R_1$ $(R')_3$ Y, $R_1$ $R_2$ $R_3$ Y—NH—$YR_1$ $R_2$ $R_3$, and combinations thereof, wherein $R_1$, $R_2$ and $R_3$ are selected among hydrogen, alkyl groups with 1 to 22 carbon atoms, aryl groups with 6 to 36 carbon atoms, aromatic groups with 6 to 36 carbon atoms, polyaromatic groups with 6 to 36 carbon atoms, said groups being selected between groups identical and different from each other, and selected in turn between non-functionalized groups and functionalized groups with functional groups selected among acid, amino, thiol, sulphonic and tetra alkyl ammonium groups, R' is a hydrolysable group at a temperature between 0 and 400° C., selected from between alcoxide, halide, and trimethyllsililamino. Such halide groups can come from compounds like for example, methyltrichlorogermane, iodopropyltrimethoxysilane, titanocene dichloride, methyltrichlorotin, diethyldichlorosilane and methyl triethoxysilane. Such alcoxide groups can be for example ethoxide, methoxide, propoxide or butoxide. Such trimetthylsililamino groups can come from compounds like for example hexamethyidisilazane.

Y is at least one element selected from Si, Ge, Sn, Ti.

The reaction to produce organic species anchored on the surface can be carried out in the absence of solvents, but also by dissolving the TIQ-6 material in a solvent selected between organic solvents and inorganic solvents. Likewise the silanisation can be carried out in the absence of catalysts or in the presence of at least one catalyst which favours a reaction of an alkylsilane, alkylgermane or organometallic compound in general with Si-groups.

The zeolitic material TIQ-6 may be prepared as follows: in a first step the synthesis of the laminar precursor is carried out by mixing in an autoclave a source of silica like for example AEROSIL, CAB-O-SIL, LUDOX, tetraethylorthosilicate (TEOS), or any other known; a source of titanium and/or zirconium like for example TiCl (4), tetraethylorthotitanate (TEOTi), ZrCl (4), zirconyl chloride or any other known; some fluoride compounds like for example ammonium fluoride and hydrogen fluoride; an organic compound like 1,4-diaminobutane, ethylendiamine, 1,4-dimethylpiperazine, 1,4-diaminocyclohexane, hexamethylenimine, pirrolidine, piridine and preferably 4-amino-2,2,6,6-tetramethylpiperidine and water in adequate proportions. The synthesis takes place at temperatures between 100 and 200° C., with constant stirring of the gel and lasting 1 to 30 days, preferably between 2 and 15 days. At the end of this time, the reaction product, a white solid, is washed with distilled water, filtered and dried.

The sheets of the obtained precursor, which contain titanium and/or zirconium in their framework, are separated by intercalating voluminous organic species such as alkyl ammoniums, amines, esters, alcohols, dimethylformamide, sulphoxides, urea, chlorohydrates of amines, alone or mixtures thereof in solution. The solvent is generally water, but other organic solvents can also be used such as alcohols, esters, alkanes, alone or mixtures thereof in absence or in presence of water.

More specifically, when cetyltrimethylammonium bromide (CTMA (+)Br (−)) is employed for example, as swelling agent, the intercalation conditions are as follows: the laminar precursor is dispersed in an aqueous solution of CTMA (+)Br (−) and a tetra-alkyl ammonium hydroxide or an alkaline or alkaline-earth hydroxide, being preferred tetra-alkyl ammonium hydroxides like tetrapropylammonium hydroxide (TPA (+)OH (−)), the pH of the mixture being greater than 11. The resulting dispersion is heated to temperatures between 5 and 200° C. during periods between 0.5 and 90 hours whilst the suspension is vigorously stirred. The suspension resulting is dispersed in an excess of water, being stirred with a metal paddle of the Cowles type or any other known at speeds lying between 20 and 2000 rpm during periods not less than 1 hour. These conditions are sufficient to carry out the delamination of the precursor material. However, it is possible to employ other delamination methods such as for example treating the sample with ultrasounds, liophilisation and spray-drying.

Once the delamination has been carried out, the solids are separated and thoroughly washed in order to eliminate the excess $CTMA^+Br^-$. The obtained product is dried and is calcinated at a temperature sufficient to eliminate the organic matter occluded in the material, or at least the organic matter present on the material surface.

The materials obtained are characterized in that they have a high external surface area greater than 500 $m^2g^{-1}$ and a pore volume greater than 0.5 $cm^3$ $g^{-1}$. They are likewise characterized in that they have a highly hydroxylated surface as may be deduced from the presence of a very intense band in the IR spectrum centered at about 3745 cm (−1). Moreover the ultraviolet-visible spectrum of the TIQ-6 materials which contain Ti or Zr are characterized by the presence of an $M^{IV}$-0 charge transfer band between 200 and 220 nm.

To obtain the microporous METIQ-6 material from the zeolitic TIQ-6 material, the TIQ-6 material can be treated with reagents selected among organogermanes, organosilanes, and organometals selected among organotitanium or organotin. By means of this process to produce organic species anchored on the surface it is possible to add one or more groups which incorporate carbon-tetravalent element bonds in the zeolitic material. This reaction for incorporating these groups is carried out using compounds with formula $R_1 R_2 R_3 (R')Y$, $R_1R_2 (R')_2Y$, $R_1 (R')_3 Y$ or $R_1 R_2 R_3 Y—NH—YR_1 R_2 R_3$ in which $R_1$, $R_2$ and $R_3$ are organic groups identical to or different from each other, and can be H or the alkyl or aryl groups mentioned earlier and Y is a metal among which Si, Ge, Sn or Ti are preferred. The procedures to produce organic species anchored on the surface are well known in the state of the art, in this manner the greater part of the Si—OH and M-OH groups present in the TIQ-6 material are functionalized.

As those skilled in the art can comprehend the TIQ-6 and METIQ-6 material can be incorporated with a support material or a carrier material such as alumina, silica, silica alumina, and magnesia.

It is believed the heterogeneous catalyzed oxidation according to the present invention results in the direct oxidation of a portion of the sulfur-containing organic impurities to sulfur dioxide and/or sulfur trioxide. To the extent sulfur-containing impurities are directly oxidized to sulfur dioxide and/or sulfur trioxide, the present invention affords the advantage of a simple and reduced downstream separation process to the extent one is required for sulfur species that are not oxidized to sulfur dioxide and/or sulfur trioxide. Sulfur dioxide and trioxide are readily removed from the oxidation zone distillate effluent via a high pressure separation or any other gas liquid separation unit operation. Any portion of the sulfur oxidized sulfur-containing and/or oxidized nitrogen-containing compounds remaining in the oxidation zone distillate effluent that were not oxidized to sulfur dioxide and/or sulfur trioxide can then be separated from the effluent by conventional solvent extraction, adsorption, washing or distillation processes while the bulk of the hydrocarbon stream is unaffected. Extractions can be carried out with solvents such as DMF, methanol, acetonitrile, sulfolane, and acetic acid. Suitable adsorbents include acidic alumina, and silica. Alternatively, any sulfur-containing species having a boiling point greater than about 350° C. can be readily distilled from the distillate effluent.

The process of the present invention can achieve desulfurization to a level of below about 5 ppmw and can achieve denitrogenation to a level of below about 5 ppmw.

The process of the present invention also results in a distillate effluent a relatively low TAN number. TAN is defined as mg KOH per gram of hydrocarbon sample required to neutralize any acids in the hydrocarbon sample. The TAN numbers of products made in accordance with the process of the present invention are less than about 2.0, preferably less than about 1.0, and most preferably less than about 0.5. A high TAN number can result in a corrosive fuel.

For a more complete understanding of the present invention, reference should be now be made to the embodiments illustrated in greater detail in the Examples described below.

EXAMPLE 1

Table II below shows the results of carrying out the process of the present invention. The reactors used were a stirred, heated, 1 liter and a 300 $cm^3$ volume autoclave available from Autoclave Engineers having internal cooling coils and a means for continuous gas feed for Runs 1 and 2, respectively. The oxygen-containing gas was added at a flow rate of 1200 standard cubic centimeters per minute. The reaction time was 5 hours. The distillate feedstream had the composition set out in Table I below. In Run 1, 9 grams of TIQ-6 material was used; whereas in Run 2, 3 grams of material was used.

Run 3 shows the results of carrying out the process of the present invention using an METIQ-6 material. Run 3 used the 300 $cm^3$ reactor containing 3 grams of METIQ-6. Substantial sulfur reduction and nitrogen content reduction was achieved by using this material as well.

TABLE I

| Distillate Feed Composition Analytical Tests | |
|---|---|
| Oxygen (wt %)) | 0.10 |
| Carbon (wt %) | 87.02 |
| Hydrogen (wt %) | 12.80 |
| Sulfur (ppm) | 24 |
| Nitrogen (ppm) | 20 |
| Spec. Grav. | 0.8474 |
| API Grav. | 35.48 |
| Aromatic Carbon (%) | 20.20 |
| Hydrocarbon Type | |
| Saturates | 58.7 |
| Paraffins | 26.1 |
| Non-condensed cyclo Paraffins | 20.7 |
| Condensed Cycloparaffins, 2-rings | 7.4 |
| Condensed Cycloparaffins, 3-rings | 4.5 |
| Condensed Cycloparaffins, 4-rings | 0.0 |
| Condensed Cycloparaffins, 5-rings | 0.0 |
| Aromatics | 41.3 |
| Monoaromatics (total) | 38.0 |
| Benzenes | 20.7 |
| Naphthenebenzenes | 15.7 |
| Dinaphthenebenzenes | 1.6 |
| Diaromatics (total) | 3.3 |
| Naphthalenes | 3.3 |
| Acenaphthenes, DBZfurans | 0.0 |
| Fluorenes | 0.0 |
| Triaromatics (total) | 0.0 |
| Phenanthrenes | 0.0 |
| Naphthenephenanthrenes | 0.0 |
| Tetraaromatics (total) | 0.0 |
| Pyrenes | 0.0 |
| Chrysenes | 0.0 |
| Pentaaromatics (total) | 0.0 |
| Perylenes | 0.0 |
| Dibenzanthracenes | 0.0 |
| Thiophenoaromatics (total) | 0.0 |
| Benzothiophenes | 0.0 |
| Dibenzothiophenes | 0.0 |
| Naphthobenzothiophenes | 0.0 |
| Unidentified | 0.0 |
| GC Simulated distillation | |
| 0.5 wt % (IBP) | 239 |
| 1.0 wt % | 262 |
| 5.0 wt % | 330 |
| 10 wt % | 360 |
| 20 wt % | 395 |
| 30 wt % | 421 |
| 40 wt % | 442 |
| 50 wt % | 458 |
| 60 wt % | 476 |
| 70 wt % | 490 |
| 80 wt % | 509 |
| 90 wt % | 525 |
| 95 wt % | 536 |
| 99 wt % | 550 |
| 99.5 wt % (FBP) | 555 |

The amount of sulfur in the oxidation zone effluent was reduced at least 50 wt. % of the amount of sulfur in the feed suggesting direct oxidation of the sulfur to sulfur dioxide and/or sulfur trioxide. The remaining sulfur-containing species in the effluent were readily removed by extraction with acetic acid conditions. Also, note the process of the invention afforded a relatively low TAN number.

TABLE II

| Catalyst | Oxydesulfurization Run Run 1 TIQ6 | Run 2 TIQ6 | Run 3 METIQ6 |
|---|---|---|---|
| Reaction conditions | | | |
| Temperature, ° F. | 310 | 310 | 310 |
| Pressure, psig | 200 | 200 | 200 |
| 7% oxygen gas flow rate, sccm | 1200 | 400 | 400 |
| Rxn time, hr | 5 | 5 | 5 |
| stir speed, rpm | 900 | 900 | 900 |
| Oxidized diesel sulfur, ppm-w | 13 | 5 | 19 |
| Oxidized diesel oxygen, wt % | 0.20 | 0.14 | 0.12 |
| Oxidized diesel TAN, mg KOH/g | 0.05 | 0.03 | .05 |
| Oxidized diesel nitrogen, ppm-w | na* | <1 | na |
| Acid-washed oxidized diesel sulfur, ppm-w | 1 | 1 | 2 |
| Acid-washed oxidized diesel nitrogen, ppm-w | 1 | <1 | 5 |

*na means not analyzed

The invention claimed is:

1. A process for desulfurizing and denitrogenating a distillate feedstock to produce a refinery transportation fuel or blending components for a refinery transportation fuel wherein the feedstock contains sulfur-containing and nitrogen-containing organic impurities which process comprises:

(a) contacting the feedstock with an oxidizing gas consisting of the oxygen in oxygen-depleted air having an oxygen content of at least 0.01 percent by volume in an oxidation zone at oxidation conditions in the presence of a heterogeneous oxidation catalyst comprising a zeolitic material TIQ6 to oxidize a portion of the sulfur-containing organic impurities with oxygen to form directly sulfur dioxide and sulfur trioxide and to convert another portion of the sulfur-containing and nitrogen-containing organic impurities to oxidized sulfur-containing and nitrogen-containing organic compounds, and (b) separating a portion of the oxidized sulfur-containing and nitrogen-containing organic compounds from the oxidation zone effluent to recover a distillate effluent having a TAN number less that 0.5 mg KOH and a reduced amount of oxidized sulfur-containing and nitrogen-containing organic impurities.

2. The process of claim 1 wherein the separation comprises an acid washing step whereby the recovered distillate effluent has a level of sulfur below about 5 ppmw and a level of nitrogen below about 5 ppmw.

3. A process for desulfurizing and denitrogenating distillate feedstock to produce a refinery transportation fuel or blending components for a refinery transportation fuel wherein the feedstock contains sulfur containing and nitrogen-containing organic impurities which process comprises:

(a) contacting the feedstock with an oxidizing gas consisting of the oxygen in oxygen-depleted air having an oxygen content of at least 0.01 percent by volume in an oxidation zone at oxidation conditions in the presence of a heterogeneous oxidation catalyst comprising a zeolitic material METIQ6, to oxidize a portion of the sulfur-containing organic impurities with oxygen to form sulfur dioxide and sulfur trioxide and to convert another portion of the sulfur containing and nitrogen-containing organic impurities to oxidized sulfur-containing and nitrogen-containing organic compounds; and (b) separating a portion of the oxidized sulfur-containing and nitrogen-containing organic compounds from the oxidation zone effluent to recover a distillate effluent having a TAN number less than 0.5 mg KOH and a reduced amount of oxidized sulfur-containing and nitrogen-containing compounds organic impurities.

4. The process of claim 3 wherein the separation comprises an acid washing step whereby the recovered distillate effluent has a level of sulfur below about 5 ppmw and a level of nitrogen below about 5 ppmw.

5. The process of claim 3 which further comprises removing from the oxidation zone distillate effluent a portion of the sulfur dioxide and/or sulfur trioxide via a gas-liquid separation operation.

6. The process of claim 3 wherein the separation step comprises distillation to a cut point temperature of about 350 degrees C.

7. The process of claim 1 which further comprises removing from the oxidation zone distillate effluent a portion of the sulfur dioxide and/or sulfur trioxide via a gas-liquid separation operation.

8. The process of claim 1 wherein the separation step comprises distillation to a cut point temperature of about 350 degrees C.

* * * * *